US005372775A

United States Patent [19]

Hayashi et al.

[11] Patent Number: 5,372,775

[45] Date of Patent: Dec. 13, 1994

[54] METHOD OF PREPARING PARTICLE COMPOSITE ALLOY HAVING AN ALUMINUM MATRIX

[75] Inventors: Tetsuya Hayashi; Yoshinobu Takeda, both of Hyogo, Japan

[73] Assignee: Sumitomo Electric Industries, Ltd., Osaka, Japan

[21] Appl. No.: 930,187

[22] Filed: Aug. 17, 1992

[30] Foreign Application Priority Data

Aug. 22, 1991 [JP] Japan ..... 3-210712
Sep. 20, 1991 [JP] Japan ..... 3-270109

[51] Int. Cl.[5] ..... B22F 3/12

[52] U.S. Cl. ..... 419/10; 419/12; 419/13; 419/14; 419/17; 419/19; 419/31; 419/33; 419/47

[58] Field of Search ..... 419/10, 12, 13, 14, 419/17, 19, 31, 33, 47

[56] References Cited

U.S. PATENT DOCUMENTS

| | | | |
|---|---|---|---|
| 2,967,351 | 1/1961 | Roberts et al. | 29/420.5 |
| 4,174,232 | 11/1979 | Lenz et al. | 148/2 |
| 4,690,796 | 9/1987 | Paliwal | 419/12 |
| 4,755,221 | 7/1988 | Paliwal et al. | 75/244 |
| 4,812,289 | 3/1989 | Alexander | 420/528 |
| 4,915,729 | 4/1990 | Boswell et al. | 75/331 |
| 4,959,195 | 9/1990 | Kusui et al. | 419/67 |
| 4,963,322 | 10/1990 | Faure | 419/33 |
| 4,973,522 | 11/1990 | Jordan et al. | 428/614 |

FOREIGN PATENT DOCUMENTS 63-12927 3/1988 Japan .

OTHER PUBLICATIONS

Petrovich, A. I. "Making Dispersion-Hardened Metals and Alloys", IBM Technical Disclosure Bulletin, vol. 11, No. 11, Apr. 1969, pp. 1450–1451.

*Primary Examiner*—Donald P. Walsh
*Assistant Examiner*—Chrisman D. Carroll
*Attorney, Agent, or Firm*—W. G. Fasse; W. F. Fasse

[57] ABSTRACT

To prepare an aluminum matrix particle composite alloy, a molten metal, mainly composed of aluminum, containing ceramic particles is disintegrated by atomization, to prepare atomized powder. The atomized powder is mechanically ground/reflocculated with a ball mill or the like, to prepare mechanically ground/reflocculated powder containing ceramic particles of not more than 8 μm in maximum diameter and not more than 3 μm in mean particle diameter. The mechanically ground/reflocculated powder is then warm-formed/-solidified. Alternatively, an aluminum alloy molten metal containing dispersed particles is disintegrated by atomization, and thereafter the powder containing the dispersed particles of not more than 20 μm in mean particle diameter is warm-formed/solidified by powder forging. Thus, it is possible to obtain an aluminum matrix particle composite alloy in which extra-fine ceramic particles are homogeneously distributed without segregation.

9 Claims, 1 Drawing Sheet

METHOD OF PREPARING PARTICLE COMPOSITE ALLOY HAVING AN ALUMINUM MATRIX

BACKGROUND OF THE INVENTION

1. Field of the Invention

The present invention relates to a method of preparing an MMC (metal matrix composite material), and more particularly, to a method of preparing an aluminum matrix particle composite alloy containing ceramic particles by powder forging.

2. Background Information

An MMC, which has mechanical strength and physical characteristics (Young's modulus etc.) equivalent to those of iron, titanium etc. and is lightweight, can usefully be substituted for iron or titanium as a component material for household electrical apparatus, business machines, robots etc.

MMCs can be prepared by either of two methods, i.e., casting and powder metallurgy. Casting includes long fiber reinforcing, short fiber reinforcing and particle reinforcing methods. On the other hand, powder metallurgy includes only short fiber reinforcing and particle reinforcing. Using powder metallurgy, it is possible to obtain a matrix alloy with a higher degree of freedom. The alloy prepared by the powder metallurgy method has a higher strength compared to the casting method, thereby obtaining a highly reliable component without mold cavity casting defects. However, powder metallurgy has the disadvantage that mixed reinforcing particles segregate in old powder boundaries and the particles themselves are large even if no segregation takes place. Casting also has problems of gravity segregation in solidification and the size of particles.

In order to prepare an MMC in which reinforcing particles are homogeneously dispersed, the particles are generally added by a mixing method, which is economical, easy and effective in improving physical characteristic values. Using this method, however, it is difficult to attain sufficient dispersion/reinforcement in the case of simple mixed powder since the dispersed particles are present in the old powder boundaries, while the particles are inhibited from bonding when fine particles are dispersed. Also in casting, particles are heterogeneously dispersed since the dispersed particles move to slowly solidified portions due to gravity segregation in solidification and the slow solidification rate.

Thus, none of the conventional methods can provide an MMC which has acceptable characteristics and is economical to produce, and hence no MMC has been put into practical use. It is most important for an MMC to obtain extra-fine reinforcing particles while homogeneously distributing them without segregation.

Furthermore, an MMC is generally inferior in machinability due to the dispersion of hard particles. Thus, it is important to form MMC materials into a near net shape, i.e., a shape close to that of the final product. Therefore, it is necessary to select and specify powder characteristics allowing for the use of a conventional powder metallurgy process or the like.

SUMMARY OF THE INVENTION

An object of the present invention is to provide a method of preparing an aluminum matrix particle composite alloy, which can homogeneously distribute reinforcing particles without segregation.

Another object of the present invention is to obtain an aluminum matrix particle composite alloy which has excellent mechanical strength and physical characteristics by powder forging.

In order to homogeneously disperse reinforcing particles in an MMC, it is effective to disperse the particles in a powder by disintegrating a molten metal containing the dispersed particles.

When ceramic particles are already contained in a raw material powder, the particles are dispersed with a high uniformity coefficient, causing no flocculation or segregation. Such ceramic particles may be caused to be contained in a raw material powder by disintegrating the molten metal, in which the ceramic particles are dispersed, by atomization. The atomization can be carried out by gas atomization, using air or an inert gas such as helium or nitrogen as an atomization medium, or by rotary disc atomization. However, air atomization is generally employed.

Using air atomization, it is necessary to discharge molten metal from a nozzle with a wide nozzle opening to form a relatively coarse powder since the molten metal has a high viscosity due to the ceramic particles contained therein. The ceramic particles may be held back or retained if the flow of the molten metal is narrowed. Such composite atomized powder can be prepared by the well-known technique disclosed in the Japanese Patent Publication No. 63-12927 (1988).

Ceramic particles may be homogeneously contained in a molten metal to prevent segregation by fusing an ingot of DURALCAN composite (a tradename of Alcan Aluminum Corporation) which is reinforced by dispersed coarse particles in the composite formed by the fusion casting method, or by stirring a molten metal by induction fusion etc.

The particles which have been contained/dispersed in the molten metal are homogeneously dispersed in the as-obtained powder, which can then be molded/solidified to prepare an aluminum matrix particle composite sintered alloy in which fine reinforcing particles are homogeneously distributed without segregation.

When the particles are distributed in the powder, it is possible to obtain a material of near net shape without strong shear working such as by hot extrusion, since dispersed particles are generally not present on the old powder boundaries to prevent bonding, thereby providing an aluminum alloy with a high degree of shape flexibility.

The present invention provides a method of preparing an aluminum matrix particle composite alloy comprising the steps of disintegrating an aluminum alloy molten metal containing dispersed particles by atomization and thereafter warm-forming/solidifying the obtained powder containing the dispersed particles (less than 20 μm in mean particle diameter) by powder forging.

Preferably, the aluminum alloy molten metal simultaneously contains 4.0 to 40.0 percent of Si by weight and 0.2 to 4.0 percent of Mg by weight, as well as less than 10 percent by weight of at least one component selected from Cu, Zn, Mn, Fe, Ni, Cr and Zr as needed, and a residue substantially composed of aluminum.

The composite powder volume should be composed of 2 to 40 percent of particles of at least one element selected from intermetallic compounds, carbides, oxides, nitrides, borides and silicides.

Preferably, the powder forging step in the present invention is carried out by annealing the aluminum alloy powder in a temperature range of 200° to 450° C., thereafter compression-molding the annealed powder by cold forming to a density ratio of at least 70 percent, and molding/solidifying the compact to a true density ratio of at least 99 percent in a temperature range of 400° to 550° C.

As for the alloy components of the molten metal, Si is added to effectively reduce the thermal expansion coefficient and improve the Young's modulus, hardness, strength and wear resistance. According to the present invention, the lowest limit of Si content is 4.0 percent by weight since the effects cannot be sufficiently attained if the Si content is less than this value. On the other hand, the upper limit of the Si content is 40 percent by weight, since the primary crystals of Si are produced to form coarse particles in sintering and deteriorate the toughness if Si exceeds 40 percent of the eutectic composition.

Magnesium is partially combined with oxygen on the powder surface to form an oxide film thereby promoting parting of the surface oxide film in solidification, whereby this can also improve mechanical properties through solution heat treatment/aging treatment, due to coexistence with Si. These effects are insufficient if the Mg content is not more than 0.2 percent by weight, while the strength of the powder-forged body deteriorates if the Mg content exceeds 4.0 percent by weight.

It is possible to effectively add Cu, Zn, Mn, Fe, Ni, Cr, Zr etc., in order to improve wear resistance by increasing the strength and hardness of the base. If the total content of these elements exceeds 10 percent by weight, however, the alloy is reduced in toughness and deteriorates in molding compressibility.

The dispersed particles may be properly selected so far as they can improve the thermal expansion coefficient, rigidity, strength, wear resistance and the like upon composition, while they must not be dispersed, diffused or condensed/grown by heating. Therefore, the particles are selected from intermetallic compounds (transition metal aluminide and transition intermetallic compounds), carbides (aluminum carbide, silicon carbide, titanium carbide, boron carbide and the like), oxides (alumina, silica, mullite, zinc oxide, yttria and the like), nitrides (aluminum nitride, silicon nitride and titanium nitride), a boride (titanium boride), a silicide (molybdenum silicide) etc.

The diameters of the particles are preferably about 0.1 to 1 μm for the purpose of dispersion/reinforcement, about 1 to 10 μm to attain composite effects, and about 5 to 20 μm for improving wear resistance. The particles are preferably not more than 20 μm in mean particle diameter since the ceramic particles may crack, forming defects from pressure applied in molding-/solidification, or they may serve as defects when stress is applied to the solidified body, reducing toughness and ductility if the mean particle diameter exceeds 20 μm.

It is of course possible to disperse a plurality of types of particles or particles with a grain size distribution. The content of such particles is preferably 2 to 40 percent by volume since an effect cannot be attained if the content is less than 2 percent by volume, while compressibility as well as machinability and toughness deteriorate if the content exceeds 40 percent by volume.

The optimum grain size distribution of the powder, which depends on flowability, compactibility, the degree of sintering etc., is preferably not more than 300 μm in general, and more preferably not more than 150 μm.

The powder is annealed at a temperature of 200° to 450° C., to improve compactibility and compressibility. The annealing temperature is set in the range of 200° to 450° C. because no remarkable improvement is attained if the annealing temperature is lower than 200° C., while the powder may be disadvantageously oxidized if the annealing temperature exceeds 450° C. While a particular retention time is not required for such annealing and sufficient effects can be attained when a target temperature is reached, the powder may be heated for 30 to 60 minutes in order to ensure homogeneity of the treatment.

The powder is cold-formed into a powder compact in a density ratio of at least 70 percent, since the strength of the compact is reduced if the molding density ratio is less than 70 percent. The powder is generally cold-formed, while it can alternatively be warm-formed.

The compact is then heated to a solidification temperature. As for the heating atmosphere, it is necessary to sinter the compact in a non-oxidizing atmosphere of $N_2$ gas, Ar gas or a vacuum under low steam partial pressure with a dew point of less than 0° C., preferably not more than −30° C., in order to sufficiently remove absorbed moisture from the powder surface and suppress the growth of an oxide film which hinders sintering in the heating process. The heating temperature is selected in a range of 400° to 550° C. since the powder exhibits such remarkable flow stress that a high solidification pressure is required, thereby increasing the equipment load, and sufficient solid phase diffusion is not attained if the heating temperature is below 400° C. On the other hand, the structure is brought into a coarse state and the mechanical properties deteriorate if the heating temperature exceeds 550° C.

The powder solidified body is heat treated, to ensure tensile strength of at least 35 kg/mm$^2$, fracture elongation of at least 1 percent, and an impact value of at least 0.4 kg·m/cm$^2$.

In a method of preparing an aluminum matrix particle composite alloy according to another aspect of the present invention, a molten metal, mainly composed of aluminum, containing ceramic particles is disintegrated by atomization, to prepare the atomized powder. The atomized powder is mechanically ground and reflocculated to prepare a mechanically ground/reflocculated powder, containing the ceramic particles, of not more than 8 μm in maximum particle diameter and not more than 3 μm in mean particle diameter. The mechanically ground/reflocculated powder is then warm-formed/-solidified.

When the powder to be subjected to mechanical grinding/reflocculation already contains ceramic particles, it is possible to reduce the amount of energy required for homogeneously dispersing the ceramic particles by mechanical grinding/reflocculation, as well as to obtain powder which is in a dispersed state with a high uniformity coefficient without flocculation and segregation of the dispersed particles.

The ceramic particles to be added to the molten metal are preferably coarse so as to be dispersed in the molten metal more effectively, as flocculation may result from the addition of a large amount of fine particles. The ceramic particles are refined as the treatment time for mechanical grinding/reflocculation is increased. Even if coarse ceramic particles exceeding 10 μm in diameter are added to a molten metal, it is possible to work them into the desired diameters by increasing the treatment time of mechanical grinding/reflocculation. However, the ceramic particles added to the molten metal are preferably smaller in size because the treatment time should be shorter in consideration of the influence of oxygen etc. contained in the mechanical grinding/reflocculation atmosphere as well as the cost for the treatment.

The obtained atomized powder is mechanically ground/reflocculated with a ball mill or an attritor. When different types of powder materials are mechanically ground/reflocculated, a dry type method called mechanical alloying (MA) is carried out in place of a conventional wet type method such as ball mill grinding or mixing. While it is possible to prevent excessive flocculation by adding a small amount of stearic acid or alcohol as a PCA (process control agent), addition of such a liquid is not necessarily required if the treatment temperature conditions etc. are controlled. The attritor is suitable for high-speed treatment, but unsuitable for mass treatment. On the other hand, the ball mill is the most economical treatment apparatus provided that the applied energy is properly designed, although it does require lengthy treatment.

When the atomized powder is mechanically ground-/reflocculated, the ceramic particles are repeatedly ground and refined so that the matrix is bonded/-granulated, incorporating the ground/refined ceramic particles, to provide a mechanically ground/reflocculated powder (hereinafter referred to as the "MG-treated powder") with a certain particle size distribution.

The maximum diameter of the ceramic particles which are contained in the MG-treated powder must not be more than 8 μm, since the ceramic particles may crack, forming defects under molding/solidification pressure, or they may serve as defects when stress is applied to the solidified body, reducing toughness or ductility, if the maximum diameter exceeds 8 μm. Preferably, the maximum diameter of the ceramic particles is not more than 5 μm.

On the other hand, the mean particle diameter of the ceramic particles contained in the MG-treated powder must be not more than 3 μm, since sufficient particle dispersion/reinforcement cannot be attained and hence toughness and ductility are reduced, if the mean particle diameter exceeds 3 μm. If the content of ceramic particles which are added to the molten metal is not more than 30 percent by volume, the mean particle diameter of the ceramic particles contained in the MG-treated powder is preferably not more than 1 μm. When a large amount of ceramic particles are added, however, the mean particle diameter thereof may be about 1 to 2 μm, in order to maintain a mean free path to some extent and prevent reduction of fracture toughness.

In the obtained MG-treated powder, the ceramic particles are finely ground and homogeneously dispersed. The MG-treated powder is heated in a necessary temperature range, and solidified in the form of a powder i.e. or as a powder compact, and thereafter pressure-solidified to provide an aluminum matrix particle composite alloy. Thus, it is possible to prepare a particle composite alloy of an aluminum matrix in which extra-fine ceramic particles are homogeneously distributed without segregation. The necessary heating conditions vary with matrix alloy compositions, but for example a temperature of at least 300° C. is generally used so that the powder materials are sufficiently diffusion-bonded in the process of solidification. The upper temperature limit exists on the solidus line of the matrix metal since the ceramic particles are not brought into coarse states even in a high temperature region. However, a temperature of not more than about 550° C. is preferable in order to solidify the powder without damaging the quench effect of the atomized powder and the intermetallic compound formed by mechanical alloying.

According to the present invention, it is possible to prepare an aluminum matrix particle composite alloy in which ceramic particles are homogeneously distributed without segregation. When the ceramic particles are homogeneously distributed without segregation, mechanical strength and physical characteristics are improved. Thus, it is possible to prepare a particle composite alloy of an aluminum matrix which has excellent mechanical strength and physical characteristics according to the present invention. Furthermore, it is possible to achieve with an aluminum alloy the mechanical strength and physical characteristics (Young's modulus and the like) required for various machine parts and sliding parts, which generally have been prepared from titanium, whereby a wide range of parts for automobiles, household electrical apparatus, business machines, robots etc. can be reduced in weight.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS AND OF THE BEST MODE OF THE INVENTION

EXAMPLE 1

Figure 2:
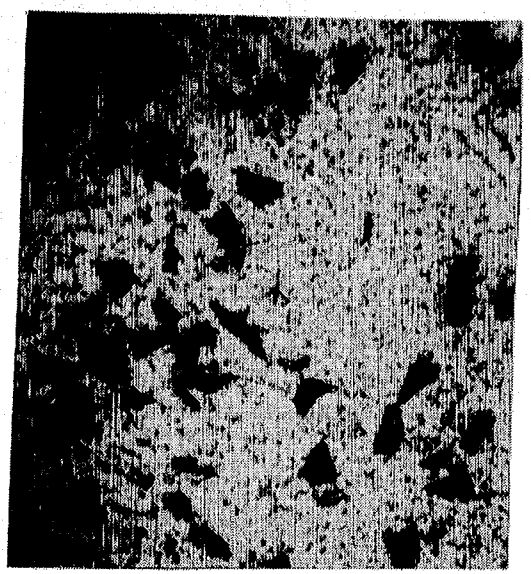
FIG. 2 shows, at 500 times magnification, the structure of the composite material of aluminum alloy sample No. (7) according to Example 1 of the present invention.
Figure 1:
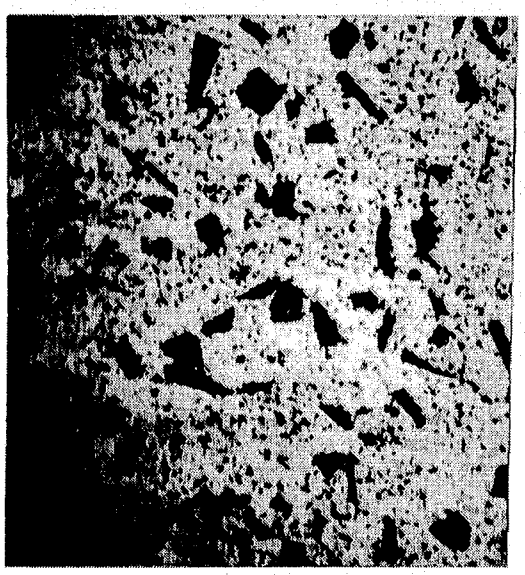
FIG. 1 shows, at 500 times magnification the structure of the composite material of aluminum alloy sample No. (1) according to Example 1 of the present invention.

Particles having mean diameters shown in Table 2 were dispersed in three types of aluminum alloy molten metals A, B and C with alloy compositions (wt. %) shown in Table 1. To prepare the powder materials of 5 to 300 μm in particle diameter by air atomization, each of these powder materials was molded into a cylindrical tablet having a diameter (symbol $\phi$) of from $\phi$120 mm to $\phi$60 mm and a thickness of $\phi$120 to $\phi$60 by 50 mm under a surface pressure of 4 t/cm$^2$ so as to prepare a compact with a density ratio of 75 percent, which in turn was heated in $N_2$ gas with a dew point of −10° C. under a furnace temperature of 480° C. and thereafter powder-forged under a surface pressure of 6 t/cm$^2$ to be solidified. The solidified body was solution heat treated at 480° C., and then aged at 170° C. for 10 hours. FIG. 1 shows the composite material structures of sample No. (1) and FIG. 2 shows the structure of sample No. (7); both magnified 500 times. On the other hand, comparative samples were prepared using composite materials and forged composite materials prepared according to a conventional mixing method or a conventional stirring method. Table 2 shows the solidification characteristics of the inventive and comparative samples.

TABLE 1

| No. | Si | Cu | Mg | Mn | Fe | Ni | Cr | Zr |
|---|---|---|---|---|---|---|---|---|
| A | 7 | 0.2 | 0.9 | 0.2 | 0.2 | Tr. | Tr. | Tr. |
| B | 12 | 3.3 | 1.1 | 0.6 | 1.8 | 1.6 | Tr. | Tr. |
| C | 25 | 2.1 | 0.7 | 1.0 | 3.2 | Tr. | 0.4 | 0.7 |

TABLE 2

| No. | Composition No. | Dispersion Preparation | Dispersed Particle Type | Dispersed Particle Mean Particle Diameter μm | Dispersed Particle Vol % | Solidified Body Characteristics Young's Modulus Kg/mm² | Solidified Body Characteristics Strength Kg/mm² | Solidified Body Characteristics Elongation % | Solidified Body Characteristics Impact Value Kgm/cm² |
|---|---|---|---|---|---|---|---|---|---|
| 1 | A | Inventive Method | SiC | 9 | 10 | 8100 | 35 | 6.1 | 1.4 |
| 2 | | | | 12 | 20 | 9700 | 37 | 2.7 | 0.6 |
| 3 | | Comparative Method: Mixing | None | | 0 | 7600 | 31 | 11.0 | 2.2 |
| 4 | | Comparative Method: Forging | SiC | 9 | 20 | 8800 | 18 | 0.1 | 0.1 |
| 5 | | Comparative Method: Stirring | None | | 0 | 7500 | 29 | 4.1 | 0.8 |
| 6 | | Comparative Method: Forging | SiC | 12 | 20 | 9500 | 34 | 0.3 | 0.2 |
| 7 | B | Inventive Method | SiC | 9 | 10 | 9900 | 44 | 2.2 | 0.7 |
| 8 | | | $ZrO_2$ | 4 | 8 | 9400 | 42 | 2.6 | 0.8 |
| 9 | | | $Al_2O_3$ | 5 | 15 | 9800 | 43 | 1.4 | 0.5 |
| 10 | | | $Si_3N_4$ | 7 | 10 | 9700 | 45 | 1.9 | 0.6 |
| 11 | C | Inventive Method | SiC | 6 | 6 | 11000 | 45 | 1.9 | 0.6 |

EXAMPLE 2

Ceramic-dispersed alloys having a composition prescribed as Japanese Industrial Standards (JIS) nominal 2024 alloys, each containing 20 percent by volume of $Al_2O_3$ or SiC ceramic particles with a mean particle diameter of 1 to 2 μm, were prepared using three methods including (1) a fusion casting method, (2) a method of adding ceramic particles in an MG treatment and solidifying the obtained MG-treated powder by powder forging, and (3) a method of MG-treating an atomized powder containing ceramic particles and solidifying the MG-treated powder by powder forging. As to the methods (2) and (3), JIS 2024 alloy powder materials of −42 mesh size particles were MG-treated with ball mills for 20 hours, heated to 490° C. and thereafter molded/solidified by forging, and then measured for transverse rupture strength values. As for the fusion casting method, samples having mean particle diameters of about 10 μm were prepared since it was difficult to disperse fine ceramic particles. Table 3 shows the results.

TABLE 3

| Particle | | Method | Ceramic Particle Diameter μm Maximum | Ceramic Particle Diameter μm Mean | Transverse Rupture Strength of Solidified Body kg/mm² | Remarks |
|---|---|---|---|---|---|---|
| $Al_2O_3$ | 1 | Fusion Casting | 6.3 | 1.8 | 50 | Extremely |
| | | | 25 | 11 | 62 | Flocculated |
| | 2 | MG Treatment of Mixed Powder | 4.5 | 1.4 | 71 | Partially Flocculated |
| | 3 | MG Treatment of Composite Powder | 3.2 | 0.9 | 81 | |
| SiC | 1 | Fusion Casting | 3.2 | 1.2 | 44 | Extremely |
| | | | 30 | 12 | 64 | Flocculated |
| | 2 | MG Treatment of Mixed Powder | 5.4 | 1.9 | 69 | Partially Flocculated |
| | 3 | MG Treatment of Composite Powder | 4.4 | 1.3 | 78 | |

According to the present invention, it is possible to prevent flocculation while increasing transverse rupture strength compared with other methods, as understood from Table 3.

EXAMPLE 3

Molten metals having a composition prescribed as JIS nominal 2024, 6061 and 7075 alloys and an Al—20 wt. % Si—3 wt. % Cu—1 wt. % Mg alloy, each containing 0 to 40 percent by volume of ceramic particles of $Al_2O_3$, $Si_3N_4$, SiC or $ZrO_2$ of 1 to 20 μm in mean particle diameter as shown in Table 4, were worked into powder materials of −42 mesh size by gas atomization, and thereafter treated with ball mills for 4 to 60 hours or with attritors for 4 to 30 hours, to prepare aluminum alloy powder materials in which ceramic particles were dispersed. These powder materials were heated to 350° to 550° C., and then molded/solidified by extrusion or forging, and then measured for Young's moduli and transverse rupture strength values. Table 4 shows the results.

TABLE 4

| No. | Alloy Composition | Ceramic Particle | vol % | MG Treatment Condition Equipment | Time Hr | Solidification Method | Ceramic Particle Diameter After MG Treatment μm Maximum | Mean | Solidified Body Characteristics Young's Modulus kg/mm² | Transverse Rupture Strength kg/mm² |
|---|---|---|---|---|---|---|---|---|---|---|
| 1 | 2024 | $Al_2O_3$ | 0 | Ball | 20 | Extrusion | — | — | 7.5 | 64 |
| 2 | | | 1 | Mill | | | 5.8 | 2.2 | 7.8 | 74 |
| 3 | | | 5 | | | | 5.1 | 2.0 | 8.0 | 77 |
| 4 | | | 10 | | | | 4.9 | 1.7 | 8.5 | 81 |
| 5 | | | 20 | | | | 5.8 | 2.4 | 10.3 | 80 |
| 6 | | | 30 | | | | 7.7 | 2.8 | 11.0 | 78 |
| 7 | | | 40 | | | | 9.8 | 3.4 | 11.8 | 70 |
| 8 | 2024 | SiC | 10 | Ball | 4 | Forging | 20 | 5.5 | 9.8 | 66 |
| 9 | | | | Mill | 12 | | 8.3 | 3.4 | 9.8 | 77 |
| 10 | | | | | 30 | | 6.1 | 2.5 | 9.8 | 83 |
| 11 | | | | | 60 | | 5.3 | 1.4 | 9.8 | 80 |
| 12 | 6061 | $Al_2O_3$ | 20 | Attori- | 4 | Forging | 9.8 | 4.3 | 10.3 | 42 |
| 13 | | | | tor | 12 | | 5.9 | 2.0 | 10.4 | 58 |
| 14 | | | | | 30 | | 3.8 | 1.2 | 10.3 | 60 |
| 15 | 7075 | — | — | Attori- | 20 | Extrusion | — | — | 7.2 | 88 |
| 16 | | $Si_3N_4$ | 8 | tor | | | 3.5 | 1.1 | 8.3 | 97 |
| 17 | | $ZrO_2$ | 8 | | | | 2.3 | 0.7 | 8.1 | 101 |
| 18 | Al | — | — | Ball | 12 | Forging | — | — | 9.1 | 73 |
| 19 | −20 Si | SiC | 5 | Mill | | | 5.0 | 2.2 | 9.5 | 82 |
| 20 | −3 Cu −1 Mg | $Al_2O_3$ | 10 | | | | 2.1 | 0.6 | 9.6 | 84 |

Referring to Table 4, Nos. 2 to 6, 10, 11, 13, 14, 16, 17, 19 and 20 are inventive samples. A composite alloy preferably has a small Young's modulus, which is related to ductility and toughness, and high transverse rupture strength, which is related to mechanical strength. According to the present invention, it is possible to prepare an aluminum matrix particle composite alloy with excellent solidified body properties, as understood from Table 4.

Although the present invention has been described and illustrated in detail, it is clearly understood that it is by way of an illustration and example only and is not to be taken as a limitation, the spirit and scope of the present invention being limited only by the terms of the appended claims.

What is claimed is:

1. A method of preparing an aluminum matrix particle composite alloy containing dispersed ceramic particles, the method comprising the following steps:

(a) providing a molten metal of an aluminum alloy, containing said ceramic particles;

(b) disintegrating, by atomization, said aluminum alloy molten metal containing said ceramic particles to prepare a powder of composite grains containing said particles being not more than 20 μm in mean particle diameter; and (c) warm-forming and solidifying said powder of composite grains without melting said composite grains, by powder forging said powder by annealing said powder at a temperature in a range between 200° C. and 450° C., cold compression-molding said annealed powder to form an initial compact having a true density ratio of at least 70 percent, and warm-molding and compacting said initial compact at a temperature in a range between 400° C. and 550° C. to form a final compact having a true density ratio of at least 99 percent.

2. The method of claim 1, wherein said step of providing a molten metal comprises providing said aluminum alloy molten metal containing at least 4.0 percent by weight and not more than 40.0 percent by weight of Si and at least 0.2 percent by weight and not more than 4.0 percent of Mg.

3. The method of claim 2, wherein said step of providing a molten metal further comprises providing said aluminum alloy molten metal containing not more than 10 percent by weight of at least one element selected from the group consisting of Cu, Zn, Mn, Fe, Ni, Cr and Zr.

4. The method of claim 1, wherein said step of disintegrating said aluminum alloy molten metal to prepare said powder of composite grains comprises preparing a powder of composite grains containing at least 2 percent by volume and not more than 40 percent by volume of particles of at least one member selected from the group consisting of intermetallic compounds, carbides, oxides, nitrides, borides and silicides.

5. A method of preparing an aluminum matrix particle composite alloy containing ceramic particles dispersed therein, the method comprising the following steps:

(a) providing a molten metal of an aluminum alloy, containing said ceramic particles;

(b) disintegrating, by atomization, said aluminum alloy molten metal containing said ceramic particles to prepare a first powder of composite grains containing said particles;

(c) mechanically grinding and reflocculating said first powder to prepare a second powder of composite grains containing ceramic particles of not more than 8 μm maximum particle diameter and not more than 3 μm mean particle diameter; and (d) warm-forming and solidifying said second powder by powder forging said second powder.

6. The method of claim 5, wherein said step of mechanically grinding and reflocculating said first powder comprises a treatment selected from the group consisting of treatment in a ball mill and treatment in an attritor.

7. The method of claim 5, wherein the step of mechanically grinding and reflocculating said first powder is carried out so that the maximum diameter of said ceramic particles is not more than 5 μm.

8. The method of claim 5, wherein the step of warm-forming and solidifying said second powder by powder forming comprises heating said second powder in a temperature range between 300° C. and 550° C. and pressure-solidifying said second powder.

9. A method of forming a near-finished article of manufacture of an aluminum matrix particle composite containing dispersed ceramic particles, the method comprising the following steps:

(a) providing a molten metal of an aluminum alloy, containing said ceramic particles;

(b) disintegrating, by atomization, said aluminum alloy molten metal containing said ceramic particles to prepare a powder of composite grains containing said particles being not more than 20 μm in mean particle diameter; and (c) warm-forming and solidifying said powder of composite grains by powder forging said powder, wherein said powder forging comprises annealing said powder at a temperature in a range between 200° C. and 450° C., cold compression-molding said annealed powder to form an initial compact having a true density ratio of at least 70 percent, and warm molding and compacting said initial compact at a temperature in a range between 400° C. and 550° C. to form a final compact having a true density ratio of at least 99 percent, and wherein said final compact is said near-finished article of manufacture requiring no additional working and forming other than surface machining.

* * * * *

UNITED STATES PATENT AND TRADEMARK OFFICE
CERTIFICATE OF CORRECTION

PATENT NO. : 5,372,775

DATED : December 13, 1994

INVENTOR(S) : Hayashi et al.

It is certified that error appears in the above-identified patent and that said Letters Patent is hereby corrected as shown below: Title page:

In [56] under Foreign Patent Documents, insert:

--0,262,869 4/90 Europe 1,230,705 12/89 Japan--;

In [57] Abstract line 2, after "alloy," insert --first--.

Col. 6, line 53, delete "ø120 to ø60 by".

Col. 9, Table 4, lines 12 and 15, replace "Attoritor" by --Attritor--.

Signed and Sealed this

Twenty-eight Day of March, 1995

*Attest:*

Bruce Lehman

BRUCE LEHMAN

*Attesting Officer*

*Commissioner of Patents and Trademarks*